US006430856B1

(12) United States Patent
Schwartz

(10) Patent No.: US 6,430,856 B1
(45) Date of Patent: Aug. 13, 2002

(54) CARD ASSEMBLY WITH POCKET FOR USE WITH A COMPUTER DISPLAY DEVICE

(75) Inventor: Russell J. Schwartz, Mill Valley, CA (US)

(73) Assignee: Left Coast Interactive, Mill Valley, CA (US)

( * ) Notice: Subject to any disclaimer, the term of this patent is extended or adjusted under 35 U.S.C. 154(b) by 0 days.

(21) Appl. No.: 09/633,487

(22) Filed: Aug. 7, 2000

Related U.S. Application Data

(63) Continuation-in-part of application No. 09/170,175, filed on Oct. 13, 1998, now Pat. No. 6,207,246, which is a continuation of application No. 08/539,325, filed on Oct. 4, 1995, now Pat. No. 5,819,456.

(51) Int. Cl.[7] ..... G09F 3/18

(52) U.S. Cl. ..... 40/642.01; 40/658; 40/404; 40/377; 248/918

(58) Field of Search ..... 40/642.01, 654.01, 40/729, 733, 404, 377; 248/918, 442.2

(56) References Cited

U.S. PATENT DOCUMENTS

| | | | | |
|---|---|---|---|---|
| 908,320 | A | | 12/1908 | Page |
| D52,832 | S | | 12/1918 | Szandula |
| 1,794,251 | A | | 2/1931 | Schaff |
| D181,137 | S | | 10/1957 | Furlong |
| 3,016,224 | A | | 1/1962 | Hall |
| 3,368,296 | A | | 2/1968 | Edwards |
| 3,458,946 | A | | 8/1969 | Lasswell |
| 3,516,631 | A | | 6/1970 | Santucci |
| 4,693,443 | A | | 9/1987 | Drain |
| D315,861 | S | | 4/1991 | Sachs |
| 5,078,358 | A | | 1/1992 | Egly et al. |
| 5,125,612 | A | | 6/1992 | McNeal |
| 5,301,915 | A | | 4/1994 | Bahniuk et al. |
| 5,383,642 | A | * | 1/1995 | Strassberg ..... 248/442.2 |
| 5,398,905 | A | | 3/1995 | Hinson |
| 5,505,421 | A | | 4/1996 | Marthaler |
| 5,672,105 | A | | 9/1997 | Curic |
| 5,890,309 | A | * | 4/1999 | Markarian ..... 40/733 |
| 5,988,582 | A | * | 11/1999 | Ollivo ..... 248/918 |
| D477,750 | | * | 9/2001 | Bell ..... D14/448 |

FOREIGN PATENT DOCUMENTS

| | | |
|---|---|---|
| GB | 9940 | of 1913 |

* cited by examiner

*Primary Examiner*—Cassandra H. Davis
(74) *Attorney, Agent, or Firm*—Henricks, Slavin & Holmes LLP

(57) ABSTRACT

A variety of mounting systems are provided for mounting display cards, photographs, or other material to a computer display device of a computer system. The display cards may include printed indicia showing, for example, a summary of useful software commands for use with software programs running on the computer system. In one embodiment, a pair of mounting units or hinges are provided for pivotably mounting the display cards to the computer display device so that selected cards may be pivoted into a position adjacent to a front surface of the display screen for ease of viewing. In another example, a transparent pocket is provided for receiving the display cards, with the pocket being pivotably mounted to the display device via the mounting units. By providing a pocket, the display cards are protected while in use. Also, the display cards need not include any mounting holes or other attachment elements for direct attachment to the mounting units. Rather, any suitably sized and shaped display card, photograph, sheet of paper, or the like may be inserted within the pocket for pivotal mounting to the computer display device via the mounting hinges.

13 Claims, 6 Drawing Sheets

CARD ASSEMBLY WITH POCKET FOR USE WITH A COMPUTER DISPLAY DEVICE

RELATED PATENT APPLICATIONS

This application is a continuation-in-part of U.S. patent application Ser. No. 09/170,175, filed Oct. 13, 1998, now U.S. Pat. No. 6,207,246 which was a continuation of U.S. patent application Ser. No. 08/539,325, filed Oct. 4, 1995, now U.S. Pat. No. 5,819,456 entitled "Card Assembly for Use with a Computer Display Device".

BACKGROUND OF INVENTION

I. Field of the Invention

The invention is directed towards a card assembly for use with a computer display device.

II. Background of the Invention

Often, computer users place utilitarian objects in their field of view near the display screen. Some examples of these useful items include handwritten notes and manufacturer supplied instruction guides that set forth software commands. In addition, as computer users spend countless hours facing their display screens, they often surround their display screens with decorative items that enhance the aesthetic quality of their environment.

Furthermore, in the prior art there exists several devices that allow utilitarian or decorative items to be attached to the computer display device. For example, U.S. Pat. No. 5,104,087 discloses a note/memo board that surrounds a computer display device on three sides. This board attaches to the display housing with angled brackets backed with VELCRO™ material that mate with VELCRO™ material strips on the sides and top of the display. Unfortunately, however, this note/memo board is out of the field of the user's focus as it mounts to the display device behind the plane of the display screen. Moreover, the amount of utilitarian or decorative items that can be attached to, or written on, this board is confined to the limited surface area of this board.

Under another prior art approach, a frame (such as the screen frame sold under the brand name Screenies™) is detachably affixed to more than one side of a display screen. The computer user can then use this frame for utilitarian or decorative purposes. Unfortunately, the limited surface area of this prior art device also provides a limited amount of space for attaching or writing utilitarian or decorative items. Consequently, there is a need in the art for an apparatus that enables a computer user to position a maximum amount of utilitarian and decorative items in her field of view near the display screen.

These and other needs were met by the system described in U.S. Pat. No. 5,819,456, referenced above. Briefly, the system of U.S. Pat. No. 5,819,456 relates to mounting apparatuses for mounting display cards directly to a front bezel surface of a computer display for use, for example, in training personnel to use computers, display cards may include tips and hints for using popular word processing programs, spread sheets, proprietary software programs, or other information pertaining to products and services. The display cards may include printed indicia showing, for example, a summary of useful software commands such as "short-cut" control sequences for triggering commands or scripts for customer service representatives.

Typically, the cards and the mounting apparatuses are employed as training aids to assist personnel or students in learning new material. Without the benefit of the system of U.S. Pat. No. 5,819,456, companies often train personnel, and schools train students by providing user manuals and requiring the personnel or students being trained to learn the software commands by directly consulting the user manuals. Such user manuals, however, may be expensive and may need to be replaced or supplemented with each upgrade of the software. For proprietary software, such upgrades may be frequent and such user manuals may be quite expensive, resulting in significant costs. Also, when personnel are required to learn by consulting user manuals, the time required to effectively train the personnel may also be significant. In particular, the personnel may be reluctant to frequently consult a potentially cumbersome user manual which often is not easily accessible, and therefore may not learn the necessary new material quickly or efficiently. Hence, human trainers are often employed to expedite training, resulting in still further costs.

With the system of U.S. Pat. No. 5,819,456, display cards containing, for example, a summary of pertinent software commands, are provided for mounting directly to the computer display. To learn the pertinent software commands, personnel being trained merely consult the display cards. Depending upon the information provided on the display cards, it may be completely unnecessary to provide a separate user manual. Hence, the costs associated with providing new user manuals or providing supplements or inserts to existing user manuals are substantially avoided. Rather, only the costs associated with providing the relatively inexpensive display cards and the mounting apparatuses of the invention may be incurred. Such is particularly desirable when training personnel to use proprietary software subject to frequent upgrades which would otherwise require obtaining frequent, and possibly expensive, user manual updates. Moreover, by eliminating the need to consult cumbersome user manuals, personnel being trained may be trained much more quickly and efficiently, further reducing training costs. Indeed, human trainers may no longer be required.

With the system, the display cards are mounted parallel with the display screen of the computer such that personnel being trained can easily reference information by simply glancing at the display cards. Hence, the speed by which new information provided on the cards can be consulted is greatly increased. Also, personnel being trained are simply more likely to consult reference information when such reference information is provided immediately adjacent to, and parallel with, the computer display, than when provided separately. Hence, training time can be significantly reduced.

Depending upon the amount of information required to be summarized, several display cards may be provided to personnel or students. With the system of U.S. Pat. No. 5,819,456, the display cards are pivotally mounted such that personnel or students being trained can easily flip to the card containing the desired information. Also, the display cards are mounted to the display screen of the computer using semi-ring card holding members such that the cards can be quickly replaced with new cards to accommodate upgrades, or to switch from one software program or module to another.

Although the display card system described in U.S. Pat. No. 5,819,456 represents a significant improvement over predecessor systems, still further room for improvement remains and the invention of the present application is directed to providing further improvements.

SUMMARY OF THE INVENTION

In accordance with one aspect of the invention, a system is provided which includes a computer display device having a screen, a pocket for holding one or more cards, and at least one mounting hinge for pivotably mounting the pocket to a surface of the computer display device. By providing a pocket for holding one or more cards for pivotably mounting to a computer display device, the cards are thereby protected from damage while mounted to the computer display device. Moreover, individual cards need not include any mounting holes or other mechanism for attaching the card directly to the mounting hinge. Rather, any card, photograph or sheet of paper sized to fit within the pocket can be used. As such, individuals can create their own cards containing computer processing commands, instructions, or other information for insertion into the pocket for easy reference while using the computer display device.

In an exemplary embodiment, two mounting hinges are provided for mounting to upper and lower side portions of the computer display device. Each mounting hinge includes a planar base, a semi-ring pocket-holding member, and a surface-mounting element for mounting the planar base to a front or sire surface of the computer display device. The pocket is rectangular and substantially transparent and includes an opening along a top end thereof permitting insertion and removal of one or more cards. The pocket is detachably mounted to the pair of hinges, with the pocket rotatable between a first position wherein the pocket lies parallel along a portion of the front surface of the display but not obscuring any significant portion of the screen and a second position wherein the pocket extends away from the front surface, also not obscuring any significant portion of the screen.

Other objects, features, and advantages of the invention will be described below or will be apparent from the descriptions therein in combination with the accompanying drawings.

DETAILED DESCRIPTION OF EXEMPLARY EMBODIMENTS OF THE INVENTION

The invention relates to a card assembly for use with a computer display device. In the following description, numerous details are set forth for purpose of explanation. However, one of ordinary skill in the art would realize that the invention may be practiced without the use of these specific details.

One embodiment of the card assembly includes at least one card and a card holder for holding the card. The card assembly also includes a mounting unit that connects to the card holder. This mounting unit affixes the card holder to a computer display device. For example, some embodiments of the mounting unit (such as the embodiment set forth in FIGS. 2 and 3) indirectly couple to a display device, by coupling to a rigid mating surface (such as a screen frame sold under the brand name Screenies) which attaches to one or more sides of the display device. On the other hand, alternative embodiments of the mounting unit (such as the embodiment set forth in FIG. 7) directly couple to the display device. Still other embodiments of the mounting unit (such as the embodiment set forth in FIG. 8) attach either (1) directly to the display bezel, or (2) indirectly to the display bezel through a rigid mating surface affixed to one or more sides of the display bezel.

Figure 1:
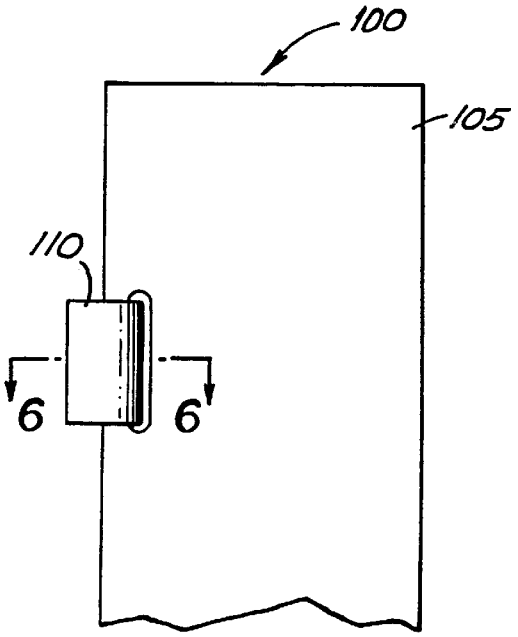
FIG. 1 is a front view of one embodiment of the card assembly of the invention.
Figure 2:
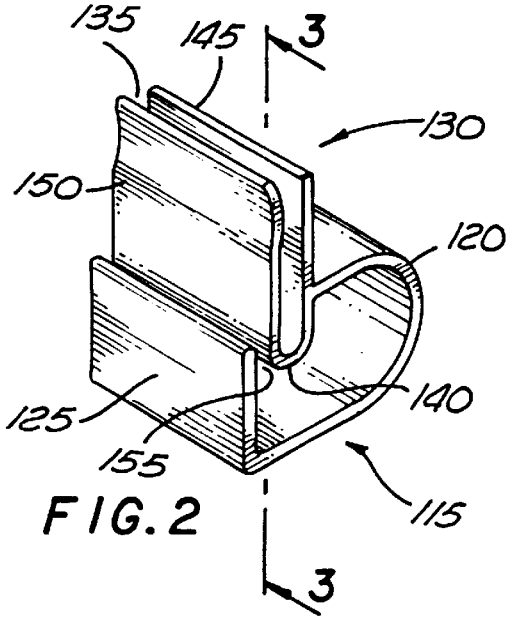
FIG. 2 is a perspective view of one embodiment of a card holder and a mounting unit of the card assembly of FIG. 1.
Figure 3:
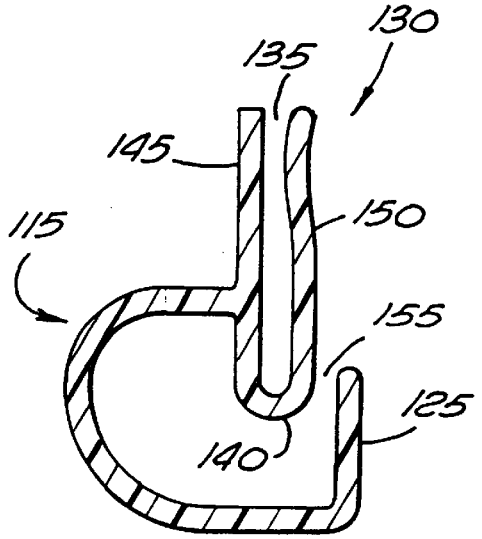
FIG. 3 is a cross-sectional view of the card holder and mounting unit of FIG. 2.

FIG. 1 sets forth a frontal view of one embodiment of the card assembly. As shown in this figure, card assembly 100 includes at least one card (105) and at least one card holding unit (110). Card holding unit 110 can have a variety of embodiments. FIGS. 2 and 3 set forth one embodiment of card holding unit 110. As shown in these figures, card holding unit 110 includes card holder 115 for holding cards and mounting unit 130 for attaching the card holder to the display device.

Figure 4:
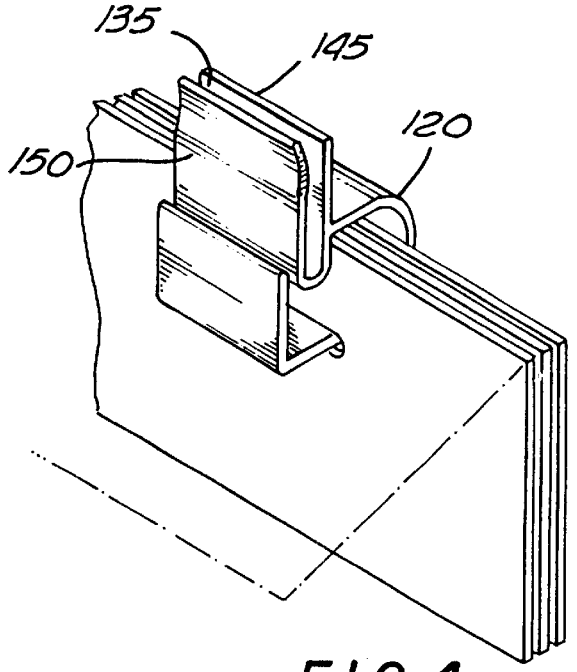
FIG. 4 is a perspective view of the card assembly of FIG. 1.

Card holder 115 includes semi-ring portion 120, which holds a card for viewing and allows the user to turn the card to view its back side or a card that is positioned behind it. Card holder 115 also includes lip 125, which (as shown in FIG. 4) passes through a hole in a card to enable the card to be inserted into the card holder's semi-ring portion. Lip 125 is a straight lip that extends from the semi-ring portion at ninety degrees. One of ordinary skill in the art would realize that, in alternative embodiments of the invention, lip 125 is not straight (as discussed below with respect to FIG. 6) and/or does not extend from the semi-ring portion at a ninety degree angle.

Figure 5:
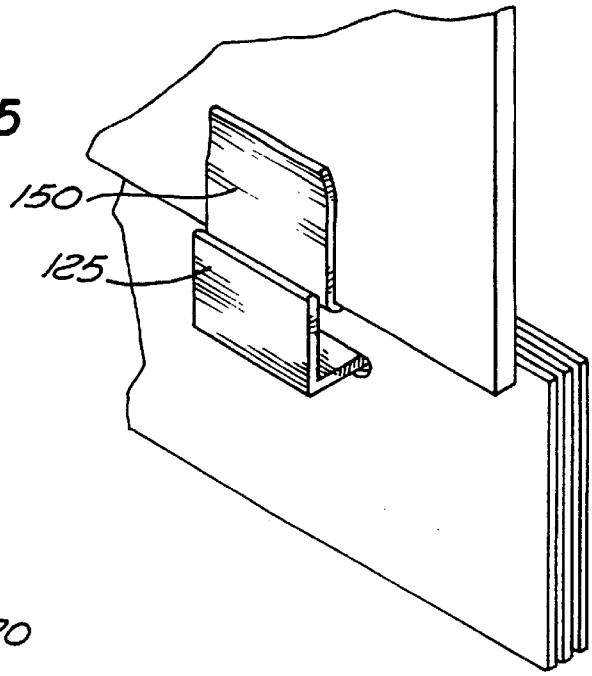
FIG. 5 is a perspective view of the mounting unit rigidly and detachably attaching the card assembly of FIG. 1 to a screen frame.

As mentioned before, card holding unit 110 also includes mounting unit 130 which, in the embodiment set forth in FIGS. 2 and 3, is a clampingjaw that rigidly and detachably affixes the card holder to a rigid mating surface (such as a screen frame) affixed to one or more sides of the display device. Clamping jaw 130 has an open end 135 and a closed end 140. The clamping jaw further has planar body 145 and curved body 150, which couple to each other at the closed end of the clamping jaw. In addition, towards the open end of the claiming jaw, surface 150 slightly bends towards surface 145, in order to rigidly (and yet detachably) engage the screen frame that is inserted through the open end of the clamping jaw. In other words, the inside surfaces of planar body 145 and curved body 150 define a camming surface that resiliently (1) bends away from curved body 145, when a screen framed is inserted into the clamping jaw, and then (2) bends back to rigidly hold onto the frame. This rigid and detachable engagement is shown in FIG. 5. Finally, lip 125 of card holder 115 and the back side of curved body 150 define an aperture 155 for allowing the cards to be inserted into card holder 115 through lip 125.

Figure 6:
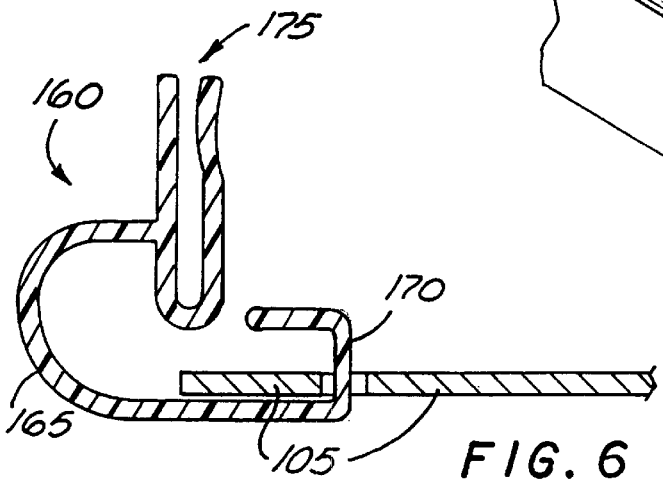
FIG. 6 is a cross-sectional view of another embodiment of the card holder of the card assembly of FIG. 1.

Numerous alternative embodiments of card holder 115 and mounting unit 130 exist. For instance, FIG. 6 presents a cross-sectional view of another embodiment of the card holder. Card holder 160 is identical to card holder 115 in that it includes a semi-ring portion (165) and a lip (170) and it connects to a clamping jaw (175), except that it has an "L" shaped lip as opposed to a straight lip. Even though this shape of lip 170 makes inserting a card into semi-ring portion 165 more difficult than when a straight lip is utilized, the use of this "L" shaped lip is advantageous in that this shape also makes it more difficult for a card to eject accidentally from the card holder.

Furthermore, an alternative embodiment of card holder 115 utilizes a lip that has a blockingend affixed to it (e.g., a ball-end threadedly affixed to it) after the cards have been inserted into the semi-ring portion. Yet another embodiment of card holder 115 does not have a lip but rather utilize an injection molded hinge clip that (1) at one end affixes to the semi-ring portion, and (2) at the other end detachably affixes either to the computer bezel or to the mounting unit. Still another embodiment of card holder 115 does not include a semi-ring portion and a lip, but rather simply includes an enclosed ring portion; the cards are inserted into this ring portion prior to its enclosure.

Figure 7:
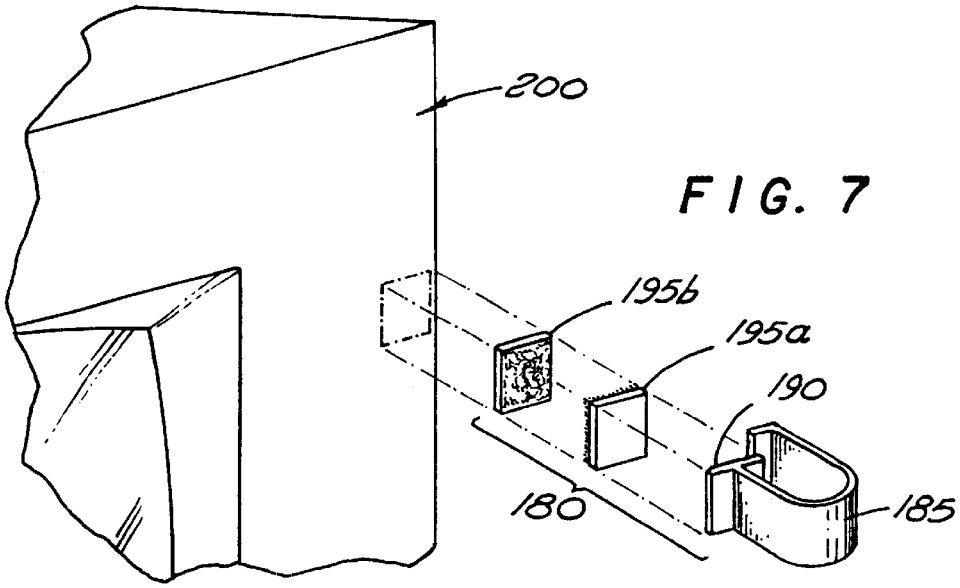
FIG. 7 illustrates another embodiment of the mounting unit.

FIG. 7 presents another embodiment of the mounting unit. As shown in this figure, mounting unit 180 directly affixes card holder 185 (which is similar to card holder 115 of FIG. 2) to the housing of a computer display device. In other words, this mounting unit replaces the clamping jaw and provides a mechanical connection between card holder 185 and display screen housing 200. This mounting unit includes planar body 190 and hook and loop fasteners 195 (such as VELCRO™ strips). Planar body 190 connects on its front side to card holder 185 and connects on its rear side to fastener 195*a*. One embodiment of fastener 195*a* adhesively attaches to the rear surface planar body 190. Fastener 195*a* then attaches to corresponding fastener 195*b* which, in one embodiment, adhesively attaches to the display bezel 200. The use of hook and loop fasteners 195 permits one card holder to be easily replaced by another.

Figure 8:
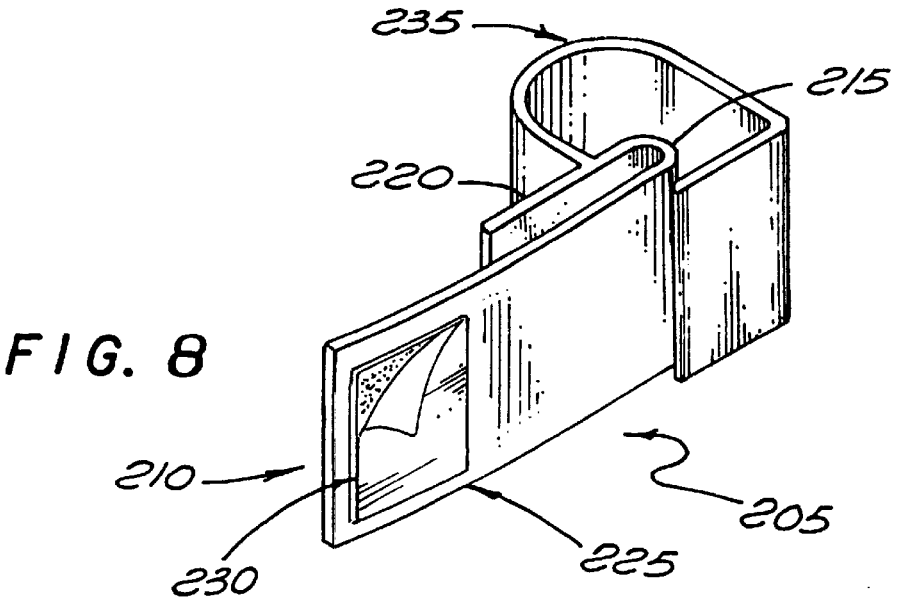
FIG. 8 illustrates yet another embodiment of the mounting unit.

FIG. 8 presents yet another embodiment of the mounting unit. This embodiment of the mounting unit can attach its card holder either (1) directly to the display bezel, or (2) indirectly to the display bezel through a rigid mating surface (e.g., a screen frame) affixed to one or more sides of the display bezel. More specifically, mounting unit 205 is a clamping jaw with an open end 210, a closed end 215, planar body 220, and curved body 225. The curved body connects to planar body 220 at closed end 215, and slightly bends body 220 towards open end 210.

In addition, mounting unit 205 also has adhesive strip 230 attached to the back side of curved body 225. Adhesive strip 230 has a plastic strip covering it when it is not being used. By removing the plastic strip covering the adhesive strip, and by pressing the uncovered adhesive strip against the display bezel, card holder 235 directly couples to the display bezel. However, if a rigid mating surface (such as a screen frame) is already attached to one or more sides of the display device, mounting unit 205 can indirectly couple card holder 235 to the display device by causing its two bodies 220 and 225 to clamp the rigid mating surface. Thus, mounting unit 205 can couple the card holder to the display bezel either directly and permanently or indirectly and detachably. Finally, alternative embodiments of the mounting units permanently attach a card holder to the display housing through the use of screws or the like.

Figure 9:
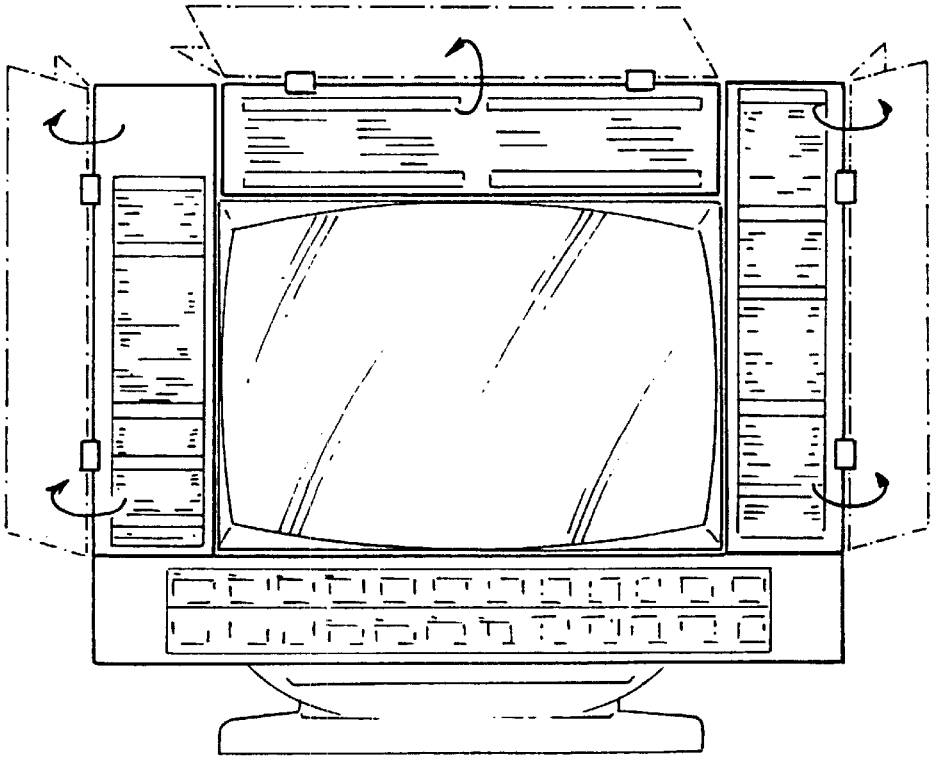
FIG. 9 illustrates one manner of utilizing one embodiment of the card assembly.

FIG. 9 sets forth one manner of utilizing one embodiment of the card assembly. As shown in this figure, three individual card assemblies of the invention can be affixed to three sides of a display screen. Each of these card assemblies includes several cards, which are held by two card holding units affixed directly or indirectly to the display screen.

As apparent from the discussion above, the invention is advantageous because, among other reasons, it maximizes the amount of utilitarian and decorative items that a user can place in her field of view near the display screen, by allowing the user to position a large number of cards around the display screen. For example, by utilizing the invention to post numerous display cards next to the display screen, a user can have a large mount of software short cuts, commands, and tips instantly available at his or her workstation without taking up any valuable desk space or computer memory.

In this manner, a user can instantly access answers to frequently asked questions and thereby increase her knowledge and proficiency. Moreover, the invention provides a natural, user-friendly way to integrate new knowledge while working. Alternatively, by using the invention to post numerous decorative cards next to the display screen, a computer user can create various decorative configurations to enhance the aesthetic quality of her working environment.

With reference to the remaining figures, alternative implementations of the invention will be described.

Figure 10:
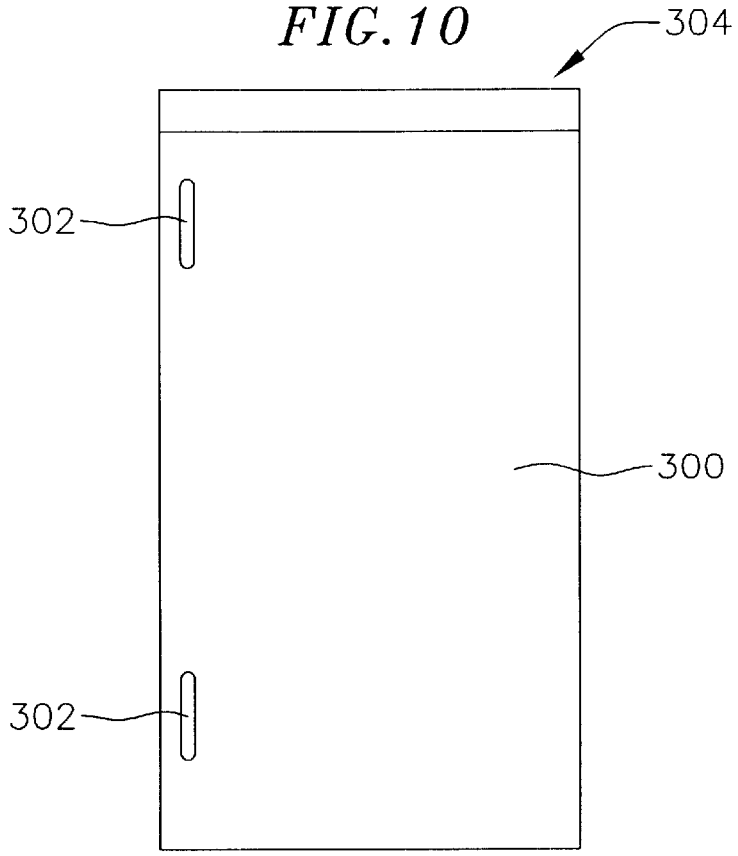
FIG. 10 illustrates a substantially transparent pocket for use with the card assembly of the invention.
Figure 11:
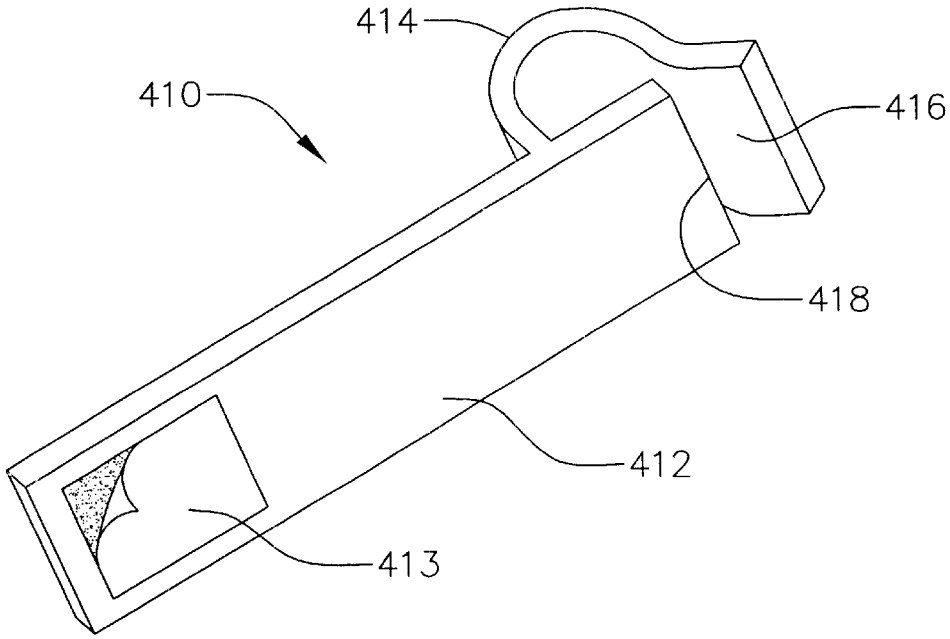
FIG. 11 is a perspective view of a mounting unit or hinge of the invention.

FIG. 10 illustrates a substantially transparent display card pocket 300 for mounting to a computer display device using a pair of mounting units or hinges such as card-holding unit 110 described above with reference to FIGS. 2 and 3 or mounting unit 410 described below with reference to FIG. 11. To this end, pocket 300 includes a pair of mounting holes or apertures 302 for mounting the pocket to the mounting units. In use, the pocket is manually positioned adjacent to a computer display device with mounting apertures 302 aligned with free ends of the mounting units, as shown and described in greater detail below. Display cards containing printed indicia such as commands for use with software programs and the like are manually inserted and removed from the pocket. An opening 304 is provided along a top edge of the pocket to permit manual insertion and removal the display cards. While positioned within the pocket, the printed indicia on the cards are visible through the pocket to permit a user of a computer system to view the list of software commands or other printed indicia contained thereon while using the computer system. Display cards or other sheet material may be inserted and removed while the pocket is mounted to the mounting units or can be inserted or removed while the pocket is de-attached from the mounting units.

By providing a pocket for holding the display cards, each individual display card need not include mounting holes sized and positioned for mounting to the mounting units. Rather, each card may simply be a rectangular card or other sheet of material sized and shaped for insertion into the pocket. Indeed, any form of generally planar sheet material can be inserted by the user into the pocket, such as photographs or sheets of paper folded to fit within the pocket. Hence, a wide range of display material can be conveniently mounted to the computer display device for ease of viewing while using the computer system. Furthermore, as these materials are inexpensive to print, they may be frequently changed to complement a variety of new software programs and upgrades of existing software programs. Additionally, the transparent pocket serves to protect the display cards or other sheets of material contained therein while in use thereby preventing possible damage, fading, or the like. Moreover, in the event the sheet of material is very thin and would otherwise bend or buckle while attached directly to the mounting unit, the pocket lends structural support to the sheet of material to ensure that the sheet remains flat for ease of viewing. To this end, the pocket is preferably formed from a reasonably sturdy, but also somewhat flexible, plastic material.

Fabrication of the display card pocket may be achieved by providing two rectangular sheets of substantially transparent plastic material, then heat-sealing all edges of the material with the exception of the top edge which remains open to provide access to the pocket. The mounting holes or apertures may thereafter be cut or punched through the pocket material. As shown in FIG. 10, the mounting holes 302 are preferably elongated oval apertures sized for fitting over the curved band of the card holding unit. In an alternative implementation, the opening may be provided along the side of the pocket rather than along the top. In still other implementations, the pocket may be configured with a movable flap or other movable closure for further securing the display card within the pocket or for expediting insertion and removable of display cards to and from the pocket.

Although any of a variety of mounting units may be employed in connection with the display card pocket of FIG. 10, including card-holding unit 110 described above, mounting unit or hinge 410 of FIG. 11 preferably is employed. Briefly, mounting unit 410 has a planar base 412 with an adhesive strip 413 for affixing the card holding unit to the computer display device. A semi-ring portion 414 is formed of a curved band extending from the planar base as shown. A free end of the semi-ring card holding member terminates in a flat portion 416 which is mostly perpendicular to the planar base but angled slightly from the perpendicular. With this configuration, the free end of the mounting member is offset slightly from end 418 of the planar base portion leaving a linear slot there-between for passage of an outer edge portion of a display card or display card pocket as the free end is passed through a respective mounting opening of the display card or pocket. The slot is sized to be substantially smaller than an inner diameter of the semi-ring portion of the mounting member such that the display card or pocket, once mounted to the mounting unit, is not easily or accidentally dislodged. The slot is also substantially smaller than a distance between the mounting holes of the display cards or pockets and the adjacent side edges thereof to further minimize accidental dislodgement. In one example, the slot is no more than one millimeter in width whereas the mounting holes of the display cards or pockets are offset about ½ centimeter from the adjacent card or pocket edge. The mounting member is formed of a somewhat flexible and resilient plastic material to permit the semi-ring portion to be bent outwardly as needed enlarge the slot and thereby facilitate ease of attachment and removal of the display card or pocket. Preferably, the mounting unit, with the exception of the adhesive strip, is formed of a single integrated plastic or vinyl material.

Figure 12:
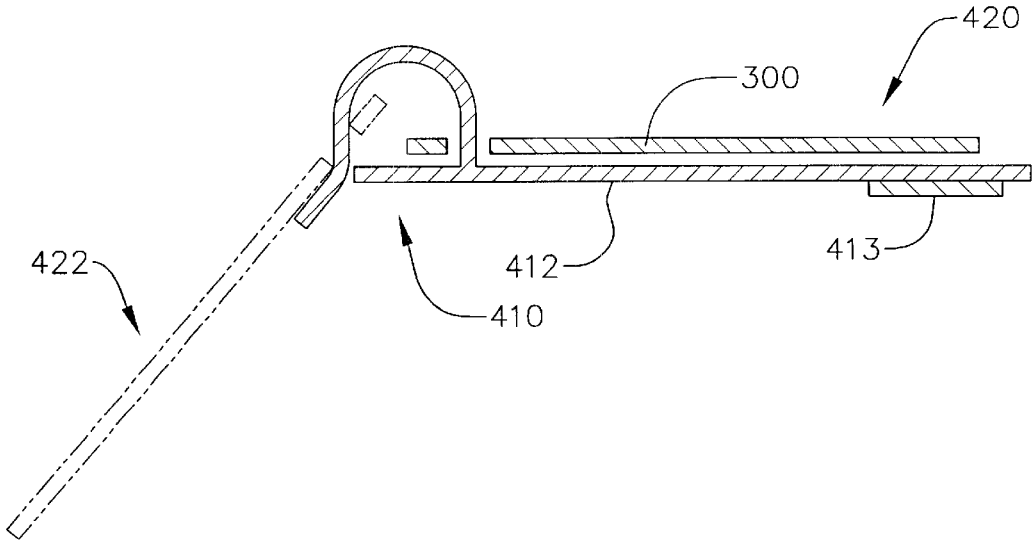
FIG. 12 is a cross-sectional side view of the mounting unit of FIG. 11, shown with the pocket of FIG. 10 mounted thereto.

FIG. 12 illustrates a display card pocket 300 mounted to a mounting unit 410 and in particular illustrates a full range of pivoting motion of the display card pocket while mounted thereto. As can be seen, in a first position or orientation 420, the display card pocket lies parallel with and against planar base portion 412. In a second orientation or position 422, shown in phantom lines within FIG. 12, the display card pocket lies parallel with and adjacent to flat end portion 416. The display card pocket is manually movable within the full angular range of motion between the first and second positions. Although FIG. 12 illustrates only a single display card pocket mounted to the mounting unit, in use multiple display card pockets may be mounted thereto. Alternatively, multiple display cards may be directly mounted thereto or combinations of display card pockets and display cards may be mounted thereto.

Figure 13:
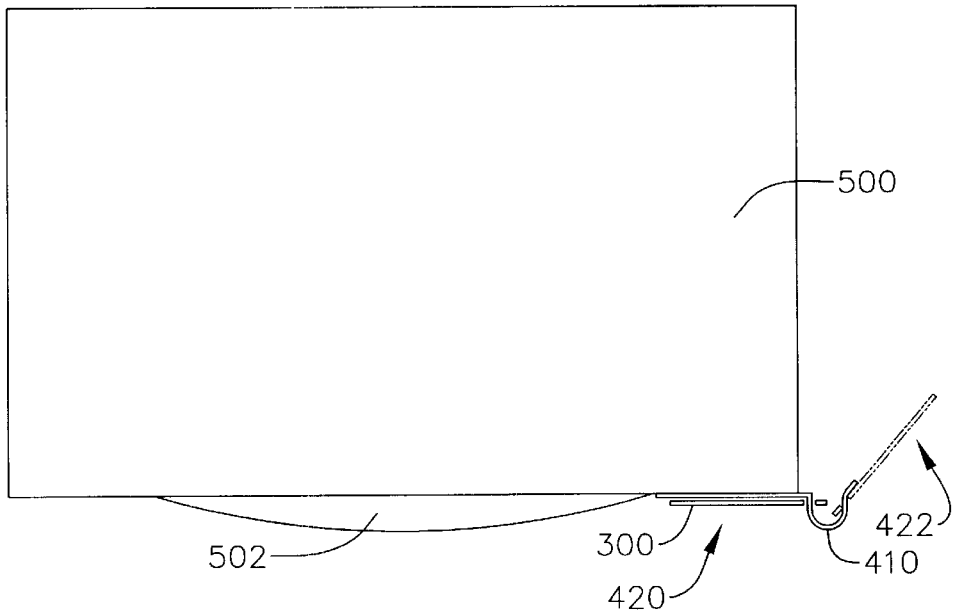
FIG. 13 is a top view of a computer display device having a pair of mounting units attached thereto carrying one of the transparent mounting pockets thereon.

FIG. 13 illustrates a single display card pocket 300 mounted to a computer display device 500 via a pair of mounting units 410, only one of which is visible in the top view of FIG. 13. As can be seen, the card holding unit is mounted with a portion of the planar base affixed to a flat front peripheral surface 502 of the computer display device which surrounds a CRT display portion 502. With this configuration, display pocket 300 is pivotable from a first position wherein the pocket lies parallel with and against the front surface of the computer display device with the pocket not obscuring any significant portion of the CRT display screen and with at least a portion of any printed indicia contained therein f acing outwardly for viewing by a user of the computer display device and a second position wherein the pocket does not lie parallel with nor against the front surface but extends away from the front surface, also not obscuring any significant portion of the screen.

Although only a single display card pocket is shown in FIG. 13, typically several display card pockets are simultaneously mounted to the computer display device with some of the pockets oriented in the first position and others in the second position, thereby permitting display material within a selected one of the pockets to be viewed. The user manually pivots display card pockets between the first position and the second position to select a particular display card for viewing. For example, one display card may provide shortcut software commands for a word processing program whereas another provides shortcut software commands for a spreadsheet program. While the user is using the spreadsheet program, the user positions the pocket containing a display card having commands pertinent to the spreadsheet program in the first position for viewing. When the user switches to the word processing program, the user manually repositions the display card pockets as needed to permit viewing of a display card having software shortcut commands pertinent to the word processing program. Depending upon the size of the mounting units, and the relative sizes and thicknesses of the various pockets, a relatively large number of display card pockets may be mounted simultaneously to the computer display device to permit the user to select from among a wide range of display cards for use with a wide range of software programs. Of course, the display card pockets need not necessarily contain display cards having software program information contained thereon. Rather, the display card pockets can contain any material that the user wishes to have positioned in proximity to the display screen, such as personal photographs, reminder notes, and the like.

One particular advantage of the arrangement illustrated in FIG. 13, is that, while in the first position, a display card to be viewed lies substantially parallel with the display CRT screen 502 of the computer display device. As such, the user need not repeatedly refocus his or her eyes between the CRT and the display card when switching back and forth between viewing the CRT and reading the display card. Rather, both the CRT and the display card lie in substantially the same field of focus, making computer work more efficient. Indeed, if the user has sufficient peripheral vision, the user may be able to view text or images displayed on the CRT screen while simultaneously viewing any printed indicia on a display card mounted within the display card pocket.

Figure 14:
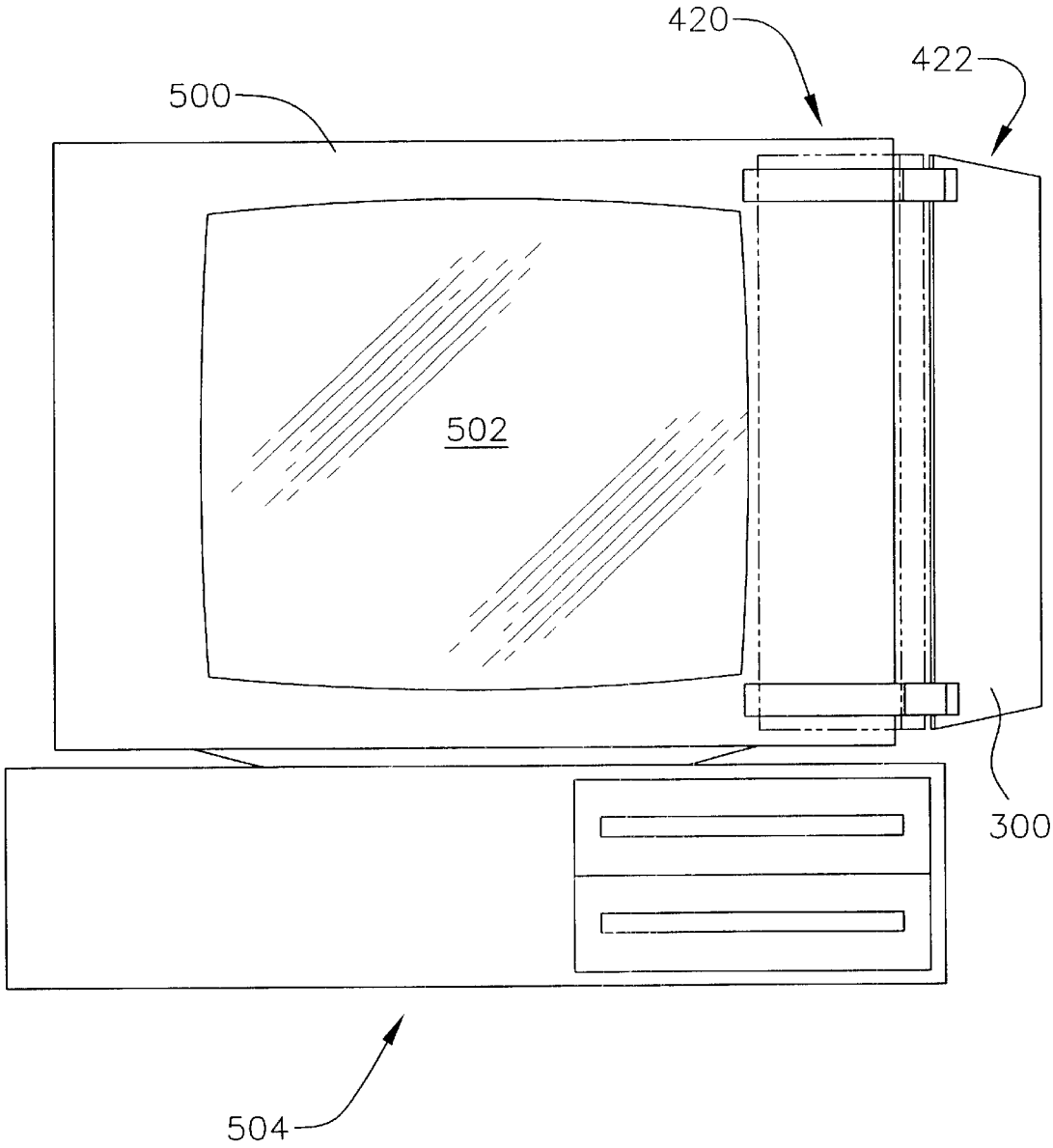
FIG. 14 is a front view of a computer system with a pair of mounting units attached to a display device of the computer system with a transparent pocket mounted thereto.

FIG. 14 illustrates a front view of a computer system 504 having a display card pocket 300 mounted via a pair of upper and lower mounting units 410 to a computer display device 500. Within FIG. 14, a display pocket in the first orientation 420 is shown in phantom lines whereas a display card pocket in the second orientation 422 is shown in solid lines. While in the first orientation, the display pocket and its contents do not obscure any portion of display screen 502 but lie flat adjacent to the peripheral surface of the computer display device surrounding display 502 so that printed indicia on cards within the pockets lie substantially in the same field of focus as the display screen itself.

While the invention has been described with reference to numerous specific details, one of ordinary skill in the art would recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A system comprising:

a computer display device having a screen;

a pocket for holding a sheet of material; and at least one mounting unit for pivotably mounting the pocket to the computer display device;

wherein the pocket is detachably mounted to the mounting unit with the pocket rotatable between a first position wherein the pocket lies parallel with a front surface of the computer display device with the pocket not obscuring any significant portion of a display screen of the computer display device and a second position wherein the pocket does not lie parallel with the front surface but extends away from the front surface also not obscuring any significant portion of the display screen.

2. A system comprising:

a computer display device having a screen;

a pocket for holding a sheet of material; and at least one mounting unit for pivotably mounting the pocket to the computer display device;

wherein each mounting unit includes a planar base;

a semi-ring member having a free end and a fixed end with the fixed end mounted to the planar base; and an adhesive strip for mounting the planar base to a surface of the computer display device.

3. The system of claim 2 wherein the fixed end of semi-ring member is mounted perpendicular to the planar base and wherein the free end of the semi-ring member terminates in a flat end portion.

4. The system of claim 3 wherein the free end of the semi-ring member is offset from an adjacent end of the planar base leaving a linear slot there-between for passage of an outer edge portion of a pocket as the free end is passed through a respective mounting opening of the pocket, the slot sized to be substantially smaller than an inner diameter of the semi-ring member such that the pocket, once mounted to the card holding members, is not easily dislodged from the card holding members.

5. A system comprising:

a computer display device having a screen;

a pocket for holding a sheet of material; and at least one mounting unit for pivotably mounting the pocket to the computer display device;

wherein first and second mounting units are provided, with the first mounting unit mounted near an upper side surface of the computer device for receiving an upper mounting hole of the pocket and with the second mounting unit mounted near a lower side surface of the computer device for receiving a lower mounting hold of the pocket.

6. A system comprising:

a computer display device having a display screen and a front surface surrounding the screen;

a display card having printed indicia thereon;

a pocket for receiving the display card; and mounting units detachably mounting the pocket to the computer display device with the pocket rotatable along an axis parallel with an outer side edge of the front surface of the computer display device from a first position wherein the pocket lies parallel with and against the front surface of the computer display device with the pocket not obscuring any significant-portion of the display screen and with at least a portion of the printed indicia of the card received within the pocket facing outwardly for viewing and a second position wherein the pocket does not lie parallel with nor against the front surface but extends away from the front surface, also not obscuring any significant portion of the display screen.

7. The system of claim 6 wherein first and second mounting units are provided, with the first mounting unit mounted near an upper side surface of the computer device for receiving an upper mounting hole of the pocket and with the second mounting unit mounted near a lower side surface of the computer device for receiving a lower mounting hold of the pocket.

8. The system of claim 6 wherein each of the mounting units comprise:

a planar base;

a semi-ring member having a free end and a fixed end with the fixed end mounted to the planar base; and an adhesive strip for mounting the planar base to a surface of the computer display device.

9. The system of claim 8 wherein the fixed end of semi-ring member is mounted perpendicular to the planar base and wherein the free end of the semi-ring member terminates in a flat end portion.

10. The system of claim 9 wherein the free end of the semi-ring member is offset from an adjacent end of the planar base leaving a linear slot there-between for passage of an outer edge portion of the pocket as the free end is passed through a respective mounting opening of the pocket, the slot sized to be substantially smaller than an inner diameter of the semi-ring member such that the pocket, once mounted to the card holding members, is not easily dislodged from the card holding members.

11. The system of claim 6 wherein first and second mounting units are provided, with the first mounting unit mounted near an upper side surface of the computer device for receiving an upper mounting hole of the pocket and with the second mounting unit mounted near a lower side surface of the computer device for receiving a lower mounting hole of the pocket.

12. The system of claim 6 wherein the pocket is substantially transparent.

13. The system of claim 6 wherein the pocket is rectangular and includes an opening along a top end thereof for permitting insertion and removal of a sheet of material.

* * * * *